US005447622A

United States Patent [19]

Kerby et al.

[11] Patent Number: 5,447,622

[45] Date of Patent: Sep. 5, 1995

[54] INTEGRATED CATALYTIC CRACKING AND OLEFIN PRODUCING PROCESS USING STAGED BACKFLOW REGENERATION

[75] Inventors: Michael C. Kerby; Roby Bearden, Jr.; Stephen M. Davis, all of Baton Rouge, La.

[73] Assignee: Exxon Research & Engineering Co., Florham Park, N.J.

[21] Appl. No.: 154,828

[22] Filed: Nov. 19, 1993

[51] Int. Cl.[6] ..... C10G 51/06; C07C 1/00

[52] U.S. Cl. ..... 208/78; 208/79; 585/312; 585/313; 585/661

[58] Field of Search ..... 208/78, 79; 585/312, 585/313

[56] References Cited

U.S. PATENT DOCUMENTS

| | | | |
|---|---|---|---|
| 3,424,672 | 1/1969 | Mitchell . | |
| 3,894,934 | 7/1975 | Owen et al. . | |
| 3,894,935 | 7/1975 | Owen . | |
| 3,930,986 | 1/1976 | Berger | 208/60 |
| 4,749,470 | 6/1988 | Herbst et al. . | |
| 4,830,728 | 5/1989 | Herbst et al. . | |
| 4,840,928 | 6/1989 | Harandi et al. . | |
| 4,859,308 | 8/1989 | Harandi et al. . | |
| 4,874,503 | 10/1989 | Herbst et al. . | |
| 4,966,681 | 10/1990 | Herbst et al. . | |
| 5,009,769 | 4/1991 | Goelzer . | |

*Primary Examiner*—Anthony McFarlane
*Assistant Examiner*—Nhat D. Phan
*Attorney, Agent, or Firm*—Richard D. Jordan

[57] ABSTRACT

Disclosed is a method which combines catalytic cracking and olefin production using a coked catalytic cracking catalyst as a dehydrogenation catalyst to dehydrogenate an alkane feed stream and form an olefin rich product stream. The method uses a staged backmixed regeneration system to form the dehydrogenation catalyst and to fully reactivate deactivated cracking catalyst for reuse in the cracking reaction. The catalyst preferably comprises a crystalline tetrahedral framework oxide component.

7 Claims, 1 Drawing Sheet

INTEGRATED CATALYTIC CRACKING AND OLEFIN PRODUCING PROCESS USING STAGED BACKFLOW REGENERATION

FIELD OF THE INVENTION

This invention relates to a catalytic cracking and olefin producing process. More particularly, this invention relates to a method which combines catalytic cracking and olefin production using staged regeneration to form a dehydrogenation catalyst which is used in the olefin production reaction. The staged regeneration process also reactivates deactivated cracking catalyst that is used in the cracking reaction.

BACKGROUND OF THE INVENTION

The emergence of low emissions fuels has created a need to increase the availability of olefins for use in alkylation, oligomerization, MTBE and ETBE synthesis. In addition, a low cost supply of olefins continues to be in demand to serve as feedstock for polyolefin production.

Fixed bed processes for light paraffin dehydrogenation have recently attracted renewed interest for increasing olefin production. However, these type of processes typically require a high capital investment as well as a high operating cost. It is, therefore, advantageous to increase olefin yield using processes which require only a minimal amount of capital investment. It would be particularly advantageous to increase olefin yield in catalytic cracking processes.

U.S. Pat. No. 4,830,728 discloses a fluid catalytic cracking (FCC) unit which is operated to maximize olefin production. The FCC unit has two separate risers in which different feed streams are introduced. The operation of the risers is designed so that a certain catalyst will act to convert a heavy gas oil in one riser and a different catalyst will act to crack a lighter olefin/naphtha feed in the other riser. Conditions within the heavy gas oil riser are modified to maximize either gasoline or olefin production. The primary means of maximizing production of the desired product is by using a specified catalyst.

A problem inherent in producing olefin products using FCC units is that the process depends upon a specific catalyst balance to maximize production. In addition, even if a specific catalyst balance can be maintained to maximize overall olefin production, olefin selectivity is generally low due to undesirable side reactions such as extensive cracking, isomerization, aromatization and hydrogen transfer reactions. It is, therefore, desirable that olefin production be maximized in a process which allows a high degree of control over olefin selectivity.

SUMMARY OF THE INVENTION

In order to overcome problems inherent in the prior art, the present invention provides an integrated catalytic cracking and alkane dehydrogenation process which comprises catalytically cracking a petroleum hydrocarbon with an active catalytic cracking catalyst to form a deactivated cracking catalyst and a cracked hydrocarbon product; regenerating the deactivated cracking catalyst under regeneration conditions in a staged backmixed regeneration system to form a dehydrogenation catalyst and a reactivated catalytic cracking catalyst; and dehydrogenating a $C_2$–$C_{10}$ alkane feed stream with the dehydrogenation catalyst.

In various preferred embodiments of the invention, the catalytic cracking catalyst comprises a zeolite crystalline framework oxide; the alkane feed stream comprises at least one component selected from the group consisting of ethane, propane, butane, pentane, hexane, heptane, octane, nonane, decane, isobutane, isopentanes, isohexanes, isoheptanes and iso-octanes; the dehydrogenation catalyst comprises about 0.2–10 wt % carbon; the alkane feed stream is dehydrogenated to an olefin product stream which comprises at least 1 wt % total olefin; the reactivated catalytic cracking catalyst comprises less than about 0.2 wt % carbon; the dehydrogenation of the alkane feed stream with the dehydrogenation catalyst forms a coked dehydrogenation catalyst and the coked dehydrogenation catalyst is regenerated under regeneration conditions in the staged backmixed regeneration system; or, the staged backmixed regeneration system comprises a plurality of backmixed regenerators in series or parallel.

BRIEF DESCRIPTION OF THE DRAWING

The present invention will be better understood by reference to the Detailed Description of the Invention when taken together with the attached drawing, wherein.

DETAILED DESCRIPTION OF THE INVENTION

Figure 1:
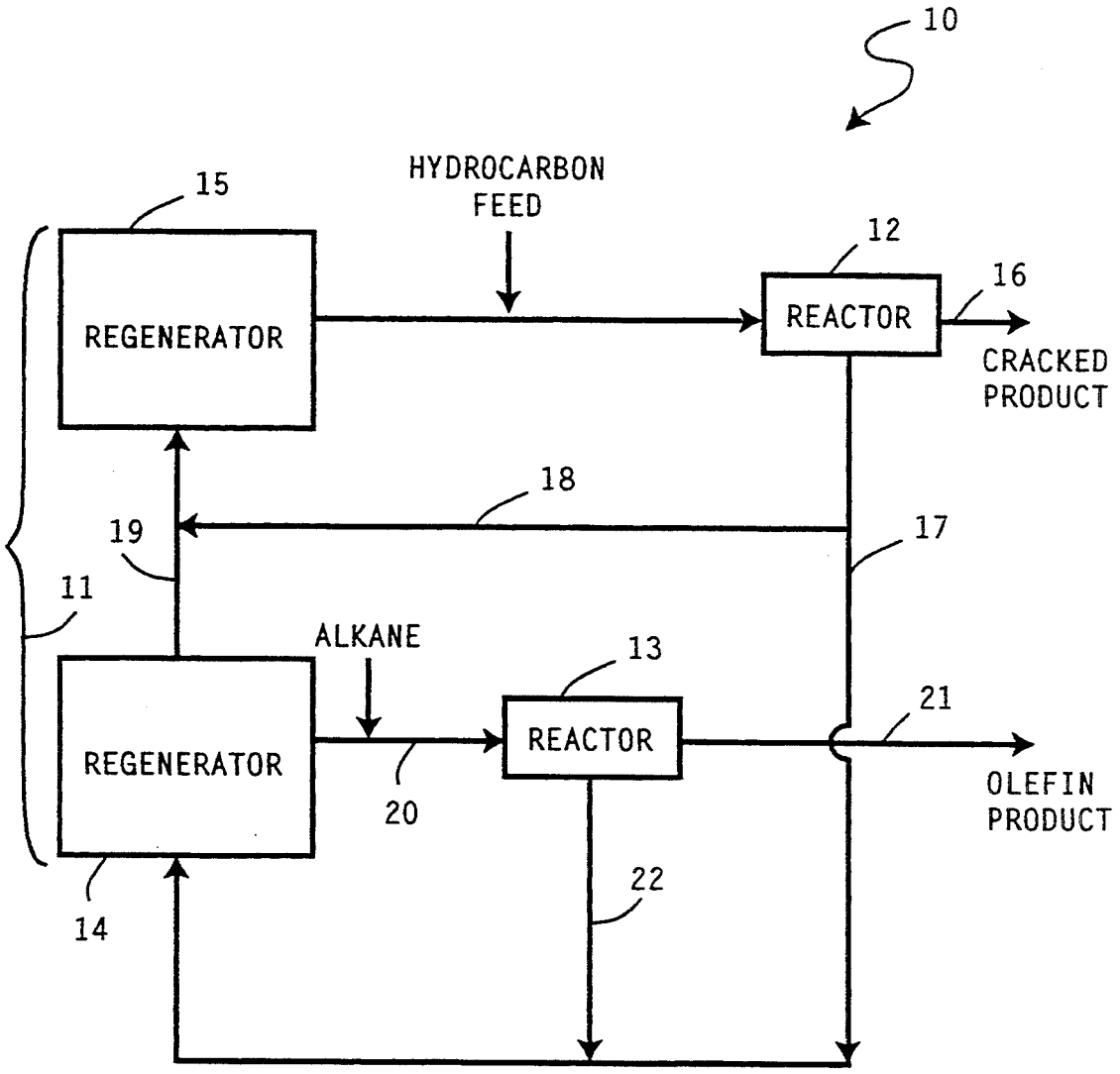
FIG. 1 is a schematic representation of a preferred embodiment of the invention.

Catalytic cracking is a process which is well known in the art of petroleum refining and generally refers to converting a large hydrocarbon molecule to a smaller hydrocarbon molecule by breaking at least one carbon to carbon bond. For example, large paraffin molecules can be cracked to a paraffin and an olefin, and a large olefin molecule can be cracked to two or more smaller olefin molecules. Long side chain molecules which may be present on aromatic rings or naphthenic rings can also be cracked.

It has been found that a coked catalytic cracking catalyst can be used to enhance the dehydrogenation of an alkane feed stream to produce an olefin stream. By using a coked catalytic cracking catalyst as the dehydrogenation catalyst, this aspect of the invention can be integrated into the catalytic cracking process to increase olefin yield in the overall reaction scheme. This increased olefin yield is advantageous since the olefin product can be used as a feedstock in other reaction processes to either increase the octane pool in a refinery, or the olefins can be used in the manufacture of gasoline additives which are required to reduce undesirable hydrocarbon emissions. In addition, the process of this invention allows for high olefin selectivity such that a portion of the olefin stream can also be used in other chemicals processes such as polyolefin production.

In the catalytic cracking step of this invention, the hydrocarbon feed is preferably a petroleum hydrocarbon. The hydrocarbon is preferably a distillate fraction having an initial ASTM boiling range of about 400° F. Such hydrocarbon fractions include gas oils, thermal oils, residual oils, cycle stocks, topped and whole crudes, tar sand oils, shale oils, synthetic fuels, heavy hydrocarbon fractions derived from the destructive hydrogenation of coal, tar, pitches, asphalts, and hydrotreated feed stocks derived from any of the foregoing.

The hydrocarbon feed is preferably introduced into a riser which feeds a catalytic cracking reactor vessel. Preferably, the feed is mixed in the riser with catalytic cracking catalyst that is continuously recycled.

The hydrocarbon feed can be mixed with steam or an inert type of gas at such conditions so as to form a highly atomized stream of a vaporous hydrocarbon-catalyst suspension. Preferably, this suspension flows through the riser into the reactor vessel. The reactor vessel is preferably operated at a temperature of about 800°–1200° F. and a pressure of about 0–100 psig.

The catalytic cracking reaction is essentially quenched by separating the catalyst from the vapor. The separated vapor comprises the cracked hydrocarbon product, and the separated catalyst comprises a carbonaceous material (i.e., coke) as a result of the catalytic cracking reaction.

The coked catalyst is preferably recycled to contact additional hydrocarbon feed after the coke material has been removed. Preferably, the coke is removed from the catalyst in a regenerator vessel by combusting the coke from the catalyst under standard regeneration conditions. Preferably, the coke is combusted at a temperature of about 900°–1400° F. and a pressure of about 0–100 psig. After the combustion step, the regenerated catalyst is recycled to the riser for contact with additional hydrocarbon feed.

The catalyst which is used in this invention can be any catalyst which is typically used to catalytically "crack" hydrocarbon feeds. It is preferred that the catalytic cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluminophophates (ALPOs) and tetrahedral silicoaluminophosphates (SAPOs). More preferably, the crystalline framework oxide component is a zeolite.

Zeolites which can be employed in accordance with this invention include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Included among the synthetic zeolites are zeolites X, Y, A, L, ZK-4, ZK-5, B, E, F, H, J, M, Q, T, W, Z, alpha and beta, ZSM-types and omega.

In general, aluminosilicate zeolites are effectively used in this invention. However, the aluminum as well as the silicon component can be substituted for other framework components. For example, the aluminum portion can be replaced by boron, gallium, titanium or trivalent metal compositions which are heavier than aluminum. Germanium can be used to replace the silicon portion.

The catalytic cracking catalyst used in this invention can further comprise an active porous inorganic oxide catalyst framework component and an inert catalyst framework component. Preferably, each component of the catalyst is held together by attachment with an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM #D3907-8). Compounds such as those disclosed in Greensfelder, B. S., et al., *Industrial and Engineering Chemistry,* pp. 2573–83, Nov. 1949, are desirable. Alumina, silica-alumina and silica-alumina-zirconia compounds are preferred.

The inert catalyst framework component densifies, strengthens and acts as a protective thermal sink. The inert catalyst framework component used in this invention preferably has a cracking activity that is not significantly greater than the acceptable thermal blank. Kaolin and other clays as well as $\alpha$-alumina, titania, zirconia, quartz and silica are examples of preferred inert components.

The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides-$\gamma$-alumina, boehmite, diaspore, and transitional aluminas such as $\alpha$-alumina, $\beta$-alumina, $\gamma$-alumina, $\delta$-alumina, $\epsilon$-alumina, $\kappa$-alumina, and $\rho$-alumina can be employed. Preferably, the alumina species is an aluminum trihydroxide such as gibbsite, bayerite, nordstrandite, or doyelite.

According to this invention, in order to produce an olefin stream, an olefin reaction is commenced by contacting an alkane feed stream with a dehydrogenation catalyst. The alkane feed stream of this invention is preferably a $C_2$–$C_{10}$ alkane composition. The alkane composition can be either branched or unbranched. Such compositions include ethane, propane, butane, pentane, hexane, heptane, octane, nonane, decane, isobutane, isopentanes, isohexanes, isoheptanes and isooctanes.

According to this invention, a coked catalytic cracking catalyst serves as the dehydrogenation catalyst. The coked catalytic cracking catalyst is a catalytic cracking catalyst, as described above, which contains a measurable content of carbonaceous material (i.e., coke) on the catalyst, and which will effectively enhance dehydrogenation of the alkane feed stream to selectively form an olefin product. Preferably, the carbon content of the dehydrogenation catalyst will be about 0.2–10 wt %, more preferably from about 0.3–5.0 wt %, most preferably from about 0.4–2.5 wt %.

The dehydrogenation catalyst can be obtained by any of numerous means. As one example, the dehydrogenation catalyst can be obtained as a result of a partial or incomplete regeneration of at least a portion of the spent catalyst stream in a FCC unit. One of ordinary skill in the art will be able to attain the desired concentration of coke on the catalytic cracking catalyst using well known means of adjusting temperature, oxygen content or burn time within the regenerator portion of the FCC unit.

The conversion of alkane to olefin in this invention generally involves a dehydrogenation reaction. In the dehydrogenation reaction, alkanes are converted to olefins and molecular hydrogen. This reaction is highly endothermic. Preferably, the dehydrogenation reaction is carried out at a temperature of about 800°–1600° F., more preferably about 800°–1400° F.

The dehydrogenation reaction is somewhat dependent upon pressure. In general, the higher the pressure, the lower the conversion of alkane to olefin. Preferably, the process is carried out at about 0–100 psig.

The contact time between the alkane stream and the dehydrogenation catalyst will also affect the yield of olefin product. Typically, optimal contact between the coked catalyst and the alkane stream is attained when the olefin product stream contains a concentration of at least about 1 wt % total olefin. Preferably, alkane vapor residence time will range from about 0.5–60 seconds, more preferably, about 1.0–10 seconds.

A preferred embodiment of this invention is shown in FIG. 1 in which the dehydrogenation reaction is incorporated into a catalytic cracking process. In the preferred embodiment, a petroleum hydrocarbon is catalytically cracked with an active catalytic cracking catalyst to form a cracked hydrocarbon product. As the catalytic cracking reaction progresses, the active catalytic cracking catalyst becomes coked. The activity of the catalytic cracking catalyst decreases as the concentration of the coke deposited on the catalyst increases. Eventually, the catalytic cracking catalyst is deactivated to the point where the catalyst is essentially ineffective in enhancing the equilibrium balance of the cracking reaction under the standard cracking conditions. At this point, the catalytic cracking catalyst is considered to be a deactivated (e.g., spent) cracking catalyst.

The deactivated cracking catalyst can be reactivated by regenerating the catalyst under standard regeneration conditions. In the present invention it is preferred to regenerate the deactivated cracking catalyst using a staged backmixed regeneration system. Using a staged backmixed regeneration system, part of the deactivated catalyst can be regenerated and reused as the dehydrogenation catalyst, and a part of the deactivated catalyst can be fully reactivated and reused in a continuous catalytic cracking reaction.

The staged backmixed regeneration system of this invention stages a plurality of backmixed regenerators in series or parallel or in a combination series and parallel configuration. As is known in the art, backmixed regenerators effectively cornbust coke from a coked catalytic cracking catalyst by thoroughly mixing an oxygen containing stream with the coked catalyst, such as is done in U.S. Pat. No. 4,830,728, described above. By staging a plurality of backmixed regenerators, regenerated catalyst can be recovered after each stage. Having more than one stage, allows catalyst to be regenerated at various severities. The end result is that more than one regenerated catalyst stream can be recovered and each regenerated catalyst stream can have the desired activity level for further use as a dehydrogenation catalyst or a reactivated catalytic cracking catalyst. In this invention, the reactivated catalytic cracking catalyst is the fully regenerated catalyst. Preferably, the reactivated catalyst has a carbon content of less than about 0.2 wt % of the total weight of the catalyst.

As shown in FIG. 1, the integrated catalytic cracking and alkane dehydrogenation process takes place generally in a FCC unit 10 which includes a staged backmixed regenerator system 11, a cracking reactor 12 and a satellite reactor 13. FIG. 1 shows a staged backmixed regenerator system 11 which includes a first stage regenerator 14 and a second stage regenerator 15. However, additional stages can be included depending upon the number of regenerated catalyst streams it is desired to recover.

The cracking reactor 12 comprises a main reactor vessel and preferably includes a riser conduit where hydrocarbon feed is injected and initially contacts reactivated catalytic cracking catalyst from the staged backmixed regenerator system 11. The catalytic cracking reaction is initiated as the hydrocarbon feed contacts the catalyst, and continues until the catalyst is separated from the hydrocarbon, typically within the cracking reactor 12. Separation can be accomplished using any of the acceptable FCC separation devices such as cyclone separators.

After separation, the cracked hydrocarbon product leaves the reactor 12 through a product line 16. The separated catalyst, which has become deactivated in the cracking reaction, leaves the reactor 12 through a recycle line 17 where the catalyst is sent to the staged backmixed regenerator system 11. To efficiently balance the overall regeneration process in the staged backmixed regeneration system 11, the spent catalyst can be sent directly to the first stage regenerator 14 or a portion can be shunted to the second stage reactor 15 through a bypass line 18.

Coke is removed from the deactivated catalyst in the staged backmixed regenerator system 11 using conventional regeneration means. Since the regeneration means used in this invention is staged, the amount of coke that is removed from the deactivated catalyst can be varied between each stage as desired.

As further shown in FIG. 1, the spent catalyst in recycle line 17 is sent to the first stage regenerator 14 where regeneration conditions are such that coke is combusted from the deactivated catalyst to form a dehydrogenation catalyst. A portion of this first stage regenerated catalyst is separated from the first stage regenerator 14 and sent to the second stage regenerator 15 through a line 19 for further coke removal, while the remaining portion of the regenerated catalyst is sent to the satellite reactor 13 through a line 20.

The satellite reactor 13 can be any type of reactor vessel that is operable under dehydrogenation conditions. For example, the satellite reactor 13 can be a transfer line riser reactor, a slumped bed reactor, a spouting bed reactor or a moving bed reactor. Preferably, the satellite reactor 13 will be capable of supporting a fluid bed catalyst at a density of about 1–45 lbs of catalyst per cubic foot of reactor volume.

As the dehydrogenation catalyst is transported through line 20, alkane feed is injected to initiate the dehydrogenation reaction. The reaction continues until the catalyst is separated from the olefin products within the satellite reactor 13. Separation can be accomplished using any of the acceptable fluidized catalyst separation devices such as cyclone separators.

After separation, the olefin product leaves the satellite reactor 13 through an olefin product line 21. The separated catalyst which is further spent in the dehydrogenation reaction leaves the reactor 13 through a recycle line 22 where it is combined with the spent catalyst in the recycle line 17 and sent back to the first stage regenerator 14 to repeat the cycle.

The second stage regenerator 15 receives the catalyst regenerated in the first stage regenerator 14 by way of the line 19. Operating conditions within the regenerator 15 are such that the remaining coke on the catalyst is further combusted to yield a fully reactivated catalytic cracking catalyst. Preferably, the reactivated catalytic cracking catalyst will have a carbon content of less than about 0.2 wt % and will be sufficiently active to effectively promote the cracking reaction in the cracking reactor 12.

The invention will be further understood by reference to the following Example, which includes a preferred embodiment of the invention.

EXAMPLE

An equilibrium zeolite beta FCC catalyst ($SiO_2$ 65.1 wt %; $Al_2O_3$ wt %; $Na_2O$ 0.28 wt %; $REO_2$ 2.14 wt %) was placed in a fixed bed quartz reactor. The temperature of the reactor was maintained at 1250° F., and the pressure was maintained at 0 psig. Six runs were made varying the total carbon content on the catalyst from 0.2 wt % to 2.7 wt %. The catalyst in runs 2–6 was pretreated with a hydrocarbon to increase the base level carbon content, thereby representing a partially regenerated spent catalyst. Iso-butane feed was passed through the reactor at 1 second residence time and GHSV of 1066. The results are shown in Table 1.

TABLE 1

| | Run Number | | | | | |
|---|---|---|---|---|---|---|
| | 001 | 002 | 003 | 004 | 005 | 006 |
| Feed Pre-Treat | none | HCN | HCN | Resid | Resid | Resid |
| Cat/Oil Pre-Treat | — | 5.1 | 3.0 | 4.8 | 3.0 | 1.8 |
| Carbon Content (wt %) | 0.2 | 0.8 | 1.1 | 2.2 | 2.5 | 2.7 |
| Feed | i-$C_4H_{10}$ | i-$C_4H_{10}$ | i-$C_4H_{10}$ | i-$C_4H_{10}$ | i-$C_4H_{10}$ | i-$C_4H_{10}$ |
| Iso-$C_4H_{10}$ Conversion (wt %) | 45.3 | 37.8 | 39.4 | 33.1 | 34.3 | 36.0 |
| Selectivity (%) | | | | | | |
| $C_1$–$C_3$ | 55.1 | 43.8 | 41.7 | 35.0 | 35.6 | 36.2 |
| n-$C_4H_{10}$ | 3.0 | 0.3 | 2.2 | 1.8 | 1.8 | 2.0 |
| 1-$C_4H_8$ | 5.6 | 7.o | 6.3 | 5.6 | 5.8 | 5.8 |
| t-2-$C_4H_8$ | 5.9 | 6.9 | 6.3 | 5.6 | 5.6 | 5.8 |

TABLE 1-continued

| | Run Number | | | | | |
|---|---|---|---|---|---|---|
| | 001 | 002 | 003 | 004 | 005 | 006 |
| c-2-$C_4H_8$ | 5.3 | 5.6 | 5.1 | 4.5 | 4.6 | 4.6 |
| Iso-$C_4H_8$ | 20.8 | 31.1 | 36.4 | 45.5 | 45.1 | 44.0 |
| >C4's | 4.4 | 5.5 | 2.1 | 1.4 | 1.5 | 1.6 |
| Iso-$C_4H_8$ Yield (wt %) | 9.4 | 11.7 | 14.3 | 15.0 | 15.5 | 15.8 |

Having now fully described this invention, it will be appreciated by those skilled in the art that the invention can be performed within a wide range of parameters within what is claimed.

What is claimed is:

1. An integrated catalytic cracking and alkane dehydrogenation process comprising:

catalytically cracking a petroleum hydrocarbon with an active catalytic cracking catalyst to form a deactivated cracking catalyst and a cracked hydrocarbon product;

regenerating the deactivated cracking catalyst under regeneration conditions in a staged backmixed regeneration system to form a dehydrogenation catalyst consisting of cracking catalyst having 0.2–10 wt % carbon thereon and a reactivated catalytic cracking catalyst; and contacting a $C_2$–$C_{10}$ alkane feed stream with a composition consisting of the dehydrogenation catalyst under dehydrogenation conditions to form an olefin product stream.

2. The process of claim 1, wherein the catalytic cracking catalyst comprises a zeolite crystalline framework oxide.

3. The process of claim 1, wherein the alkane feed stream comprises at least one component selected from the group consisting of ethane, propane, butane, pentane, hexane, heptane, octane, nonane, decane, isobutane, isopentanes, isohexanes, isoheptanes and isooctanes.

4. The process of claim 1, wherein the olefin product stream comprises at least 1 wt % total olefin.

5. The process of claim 1, wherein the reactivated catalytic cracking catalyst comprises less than about 0.2 wt % carbon.

6. The process of claim 1, wherein the contacting of the alkane feed stream with the dehydrogenation catalyst forms a coked dehydrogenation catalyst and the coked dehydrogenation catalyst is regenerated under regeneration conditions in the staged backmixed regeneration system.

7. The process of claim 1, wherein the staged backmixed regeneration system comprises a plurality of backmixed regenerators in series or parallel.

* * * * *